US010100584B1

(12) United States Patent
Schroder et al.

(10) Patent No.: US 10,100,584 B1
(45) Date of Patent: Oct. 16, 2018

(54) ROTATABLE CUTTING ELEMENTS FOR EARTH-BORING TOOLS AND EARTH-BORING TOOLS SO EQUIPPED

(71) Applicant: Baker Hughes, a GE company, LLC, Houston, TX (US)

(72) Inventors: Jon David Schroder, The Woodlands, TX (US); John Abhishek Raj Bomidi, Spring, TX (US); Kegan L. Lovelace, Houston, TX (US); Alexander Rodney Boehm, Wheat Ridge, CO (US); William A. Moss, Jr., Conroe, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 4 days.

(21) Appl. No.: 15/663,493

(22) Filed: Jul. 28, 2017

(51) Int. Cl.
*E21B 10/567* (2006.01)
*E21B 10/32* (2006.01)
*E21B 10/22* (2006.01)

(52) U.S. Cl.
CPC ..... *E21B 10/567* (2013.01); *E21B 10/22* (2013.01); *E21B 10/325* (2013.01)

(58) Field of Classification Search
CPC ..... E21B 10/567; E21B 10/22; E21B 10/325
See application file for complete search history.

(56) References Cited

U.S. PATENT DOCUMENTS 3,620,580 A * 11/1971 Cunningham ..... E21B 10/22 384/96
4,553,615 A 11/1985 Grainger
4,751,972 A 6/1988 Jones et al.
7,419,224 B2 * 9/2008 Hall et al. ..... E21C 35/183 299/104
7,604,073 B2 10/2009 Cooley et al.
7,703,559 B2 4/2010 Shen et al.
7,762,359 B1 7/2010 Miess
7,845,436 B2 12/2010 Cooley et al.
7,987,931 B2 8/2011 Cooley et al.
8,061,452 B2 11/2011 Cooley et al.
8,079,431 B1 12/2011 Cooley et al.
8,091,655 B2 1/2012 Shen et al.
8,210,285 B2 7/2012 Cooley et al.
8,413,746 B2 4/2013 Shen et al.
8,561,728 B2 10/2013 Cooley et al.
8,800,691 B2 8/2014 Shen et al.
(Continued)

*Primary Examiner* — David J Bagnell
*Assistant Examiner* — Brandon M Duck
(74) *Attorney, Agent, or Firm* — TraskBritt

(57) ABSTRACT

A cutter assembly, which may include a rotatable cutting element disposable within a pocket of an earth-boring tool, a sleeve configured to receive the rotatable cutting element, and at least one retention mechanism configured to secure the rotatable cutting element within the sleeve. The rotatable cutting element may include a substrate, a table, which may be comprised of a superhard, polycrystalline material disposed on a first end of the substrate, and a recess extending into a second, opposite end of the substrate. The sleeve may comprise at least one radial bearing surface, a backing support sized, shaped, and positioned to extend into the recess of the rotatable cutting element, and at least one axial thrust-bearing surface located on the backing support and positioned to contact the substrate within the recess.

11 Claims, 5 Drawing Sheets

(56) References Cited

U.S. PATENT DOCUMENTS

| | | | | |
|---|---|---|---|---|
| 8,881,849 | B2 | 11/2014 | Shen et al. | |
| 8,931,582 | B2 | 1/2015 | Cooley et al. | |
| 8,950,516 | B2 | 2/2015 | Newman | |
| 8,973,684 | B1 | 3/2015 | Cooley et al. | |
| 8,991,523 | B2 | 3/2015 | Shen et al. | |
| 9,016,409 | B2 | 4/2015 | Zhang et al. | |
| 9,033,070 | B2 | 5/2015 | Shen et al. | |
| 9,187,962 | B2 | 11/2015 | Burhan et al. | |
| 9,279,294 | B1 | 3/2016 | Cooley et al. | |
| 9,291,000 | B2 | 3/2016 | Zhang et al. | |
| 9,322,219 | B2 | 4/2016 | Burhan et al. | |
| 9,328,564 | B2 | 5/2016 | Zhang et al. | |
| 9,382,762 | B2 | 7/2016 | Cooley et al. | |
| 9,388,639 | B2 | 7/2016 | Patel et al. | |
| 9,464,486 | B2 | 10/2016 | Zhang et al. | |
| 2007/0278017 | A1* | 12/2007 | Shen | E21B 10/5673 175/426 |
| 2008/0017419 | A1* | 1/2008 | Cooley | B23B 27/12 175/286 |
| 2008/0251293 | A1 | 10/2008 | Mumma et al. | |
| 2014/0054094 | A1 | 2/2014 | Burhan et al. | |
| 2014/0131118 | A1 | 5/2014 | Chen et al. | |
| 2014/0326515 | A1 | 11/2014 | Shi et al. | |
| 2014/0326516 | A1 | 11/2014 | Haugvaldstad et al. | |
| 2014/0360789 | A1 | 12/2014 | Siracki et al. | |
| 2014/0360792 | A1 | 12/2014 | Azar et al. | |
| 2015/0047910 | A1 | 2/2015 | Chen et al. | |
| 2016/0084010 | A1* | 3/2016 | Beaton | E21B 10/573 175/432 |
| 2016/0290056 | A1 | 10/2016 | Propes et al. | |

* cited by examiner

ROTATABLE CUTTING ELEMENTS FOR EARTH-BORING TOOLS AND EARTH-BORING TOOLS SO EQUIPPED

FIELD

Embodiments of this disclosure relate generally to rotatable cutting elements for earth-boring tools. More specifically, embodiments disclosed in this specification relate generally to rotatable cutting elements for earth-boring tools which may reduce an axial length of the rotatable cutting elements, and to earth-boring tools so equipped.

BACKGROUND

Wellbores are formed in subterranean formations for various purposes including, for example, extraction of oil and gas from subterranean formations and extraction of geothermal heat from subterranean formations. A wellbore may be formed in a subterranean formation using an earth-boring rotary earth-boring tool. The earth-boring tool is rotated under an applied axial force, termed "weight on bit" (WOB) in the art, and advanced into the subterranean formation. As the earth-boring tool rotates, the cutters or abrasive structures of the earth-boring tool cut, crush, shear, and/or abrade away the formation material to form the wellbore.

The earth-boring tool is coupled, either directly or indirectly, to an end of what is referred to in the art as a "drill string," which includes a series of elongated tubular segments connected end-to-end that extend into the wellbore from the surface of the formation. Various tools and components, including the earth-boring tool, may be coupled together at the distal end of the drill string at the bottom of the wellbore being drilled. This assembly of tools and components is referred to in the art as a "bottom hole assembly" (BHA).

One common type of earth-boring tool used to drill well bores is known as a "fixed cutter" or "drag" bit. This type of earth-boring tool has a bit body formed from a high strength material, such as tungsten carbide or steel, or a composite/matrix bit body, having a plurality of cutters (also referred to as cutter elements, cutting elements, or inserts) attached at selected locations about the bit body. The cutters may include a substrate or support stud made of a hard material (e.g., tungsten carbide), and a mass of superhard cutting material (e.g., a polycrystalline table) secured to the substrate. Such cutting elements are commonly referred to as polycrystalline diamond compact ("PDC") cutters.

Cutting elements are typically mounted on the body of a drag drill bit by brazing. The drill bit body is formed with recesses therein, commonly termed "pockets," for receiving a substantial portion of each cutting element in a manner which presents the PDC layer at an appropriate back rake and side rake angle, facing in the direction of intended bit rotation, for cutting in accordance with the drill bit design. In such cases, a brazing compound is applied between the surface of the substrate of the cutting element and the surface of the recess on the bit body in which the cutting element is received. The cutting elements are installed in their respective recesses in the bit body, and heat is applied to each cutting clement to raise the temperature to a point high enough to braze the cutting elements to the bit body in a fixed position but not so high as to damage the PDC layer.

Unfortunately, securing a PDC cutting element to a drill bit restricts the useful life of such cutting element, as the cutting edge of the diamond table wears down as does the substrate, creating a so-called "wear flat" and necessitating increased weight on bit to maintain a given rate of penetration of the drill bit into the formation due to the increased surface area presented. In addition, unless the cutting element is heated to remove it from the bit and then rebrazed with an unworn portion of the cutting edge presented for engaging a formation, more than half of the cutting element is never used.

Rotatable cutting elements mounted for rotation about a longitudinal axis of the cutting element can be made to rotate by mounting them at an angle in the plane in which the cutting elements are rotating (side rake angle). This will allow them to wear more evenly than fixed cutting elements, having a more uniform distribution of heat across and heat dissipation from the surface of the PDC table and exhibit a significantly longer useful life without removal from the drill bit. That is, as a cutting element rotates in a bit body, different parts of the cutting edges or surfaces of the PDC table may be exposed at different times, such that more of the cutting element is used. Thus, rotatable cutting elements may have a longer life than fixed cutting elements. Additionally, rotatable cutting elements may mitigate the problem of "bit balling," which is the buildup of debris adjacent to the edge of the cutting face of the PDC table. As the PDC table rotates, the debris built up at an edge of the PDC table in contact with a subterranean formation may be forced away as the PDC table rotates and new material is cut from the formation.

BRIEF SUMMARY

In some embodiments, the present disclosure includes a rolling cutter assembly, which may include a rotatable cutting element disposable within a pocket of an earth-boring tool, a sleeve configured to receive the rotatable cutting element, and at least one retention mechanism configured to secure the rotatable cutting element within the sleeve. The rotatable cutting element may include a substrate, a table, which may be comprised of a superhard, polycrystalline material disposed on a first end of the substrate, and a recess extending into a second, opposite end of the substrate. The sleeve may comprise at least one radial bearing surface, a backing support sized, shaped, and positioned to extend into the recess of the rotatable cutting element, and at least one axial thrust-bearing surface located on the backing support and positioned to contact the substrate within the recess. In some embodiments the axial thrust-bearing surface may comprise a superhard, polycrystalline material disposed thereon. In some embodiments the axial thrust-bearing surface may be planar, hemispherical, conical, or frustoconical.

In other embodiments, the present disclosure includes an earth-boring tool, which may include a bit body, at least one blade extending outward from the bit body, at least one pocket defined in the at least one blade, at least one sleeve secured within the at least one pocket, at least one rotatable cutting element disposed within the at least one sleeve, and at least one retention mechanism securing the rotatable cutting element within the sleeve. The at least one rotatable cutting element may include a substrate, a table comprising a superhard, polycrystalline material disposed on a first end of the substrate, and a recess extending into a second opposite end of the substrate. The sleeve may include at least one radial bearing surface, a backing support extending into the recess of the rotatable cutting element, and at least one axial thrust-bearing surface located on the backing support and positioned to contact the substrate within the recess.

In other embodiments, the present disclosure includes a method of fabricating an earth-boring tool, which may involve securing a sleeve to a bit body at least partially within a pocket extending into a blade extending outward from the bit body. At least a portion of a substrate of a rotatable cutting element may be placed within a recess of the sleeve. An axial thrust-bearing surface of the sleeve may be placed in contact with the substrate of the rotatable cutting element by inserting a protrusion of the sleeve comprising the axial thrust-bearing surface into a recess extending into the substrate toward a cutting face of the rotatable cutting element and contacting the axial thrust-bearing surface against the substrate. The rotatable cutting element may be secured to the sleeve utilizing at least one retention mechanism, the retention mechanism permitting the rotatable cutting element to rotate relative to the sleeve.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
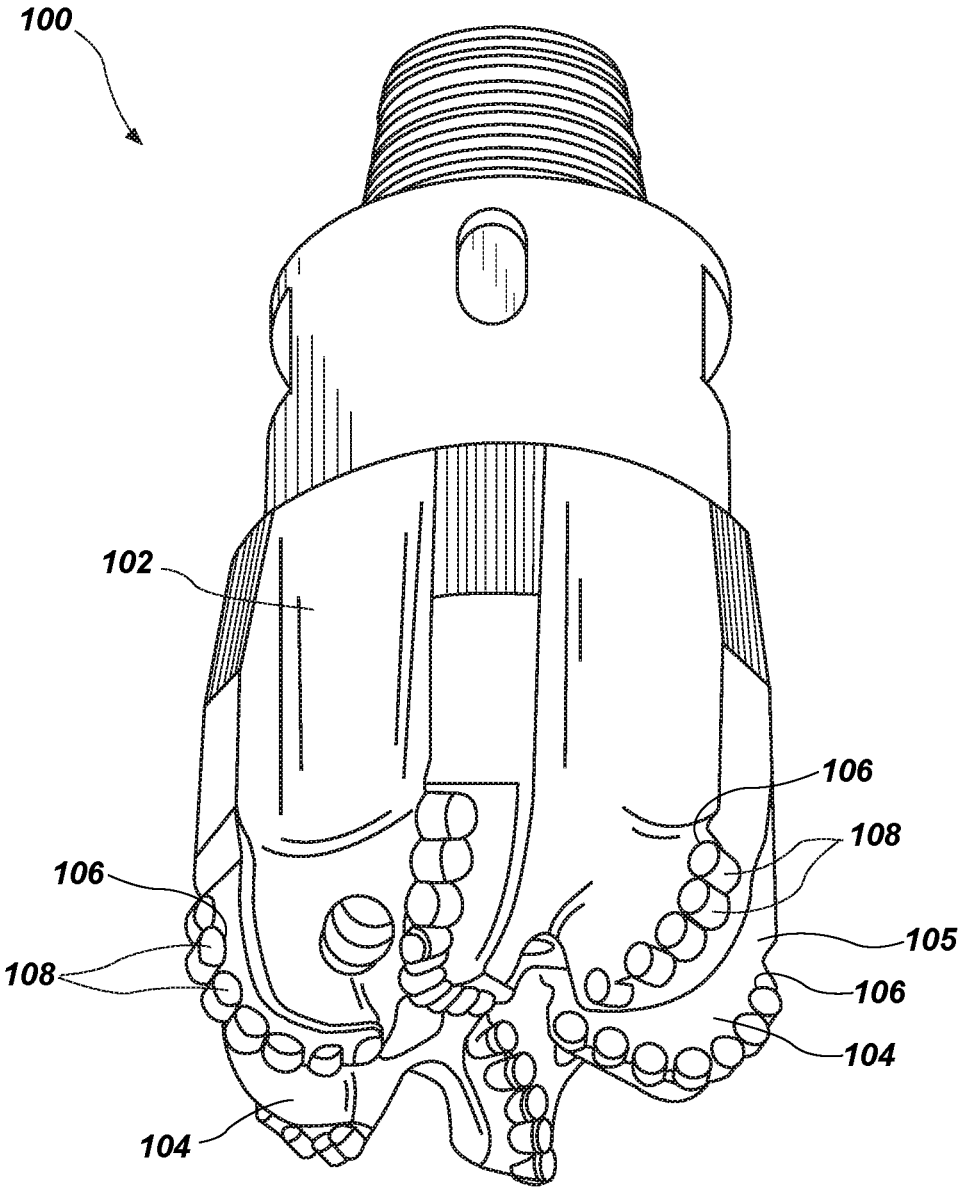
FIG. 1 is a perspective view of an example earth-boring tool including rotatable cutting elements in accordance with this disclosure.

The illustrations presented in this disclosure are not meant to be actual views of any particular material or device, but are merely idealized representations that are employed to describe the disclosed embodiments. Thus, the drawings are not necessarily to scale and relative dimensions may have been exaggerated for the sake of clarity. Additionally, elements common between figures may retain the same or similar numerical designation.

The following description provides specific details, such as material types, in order to provide a thorough description of embodiments of this disclosure. However, a person of ordinary skill in the art will understand that the embodiments of this disclosure may be practiced without employing these specific details. Indeed, the embodiments of this disclosure may be practiced in conjunction with conventional fabrication techniques and materials employed in the industry.

The illustrations presented in this disclosure are not meant to be actual views of any particular earth-boring tool or component thereof, but are merely idealized representations employed to describe illustrative embodiments. Thus, the drawings are not necessarily to scale. Disclosed embodiments relate generally to rotatable cutting elements for earth-boring tools. More specifically, disclosed are embodiments of rotatable cutting elements which may reduce an axial length of the rotatable cutting elements.

As used in this specification, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

The term "earth-boring tool," as used herein, means and includes any type of bit or tool used for drilling during the formation or enlargement of a wellbore in a subterranean formation. For example, earth-boring tools include fixed-cutter bits, core bits, eccentric bits, bicenter bits, reamers, mills, hybrid bits including both fixed and rotatable cutting structures, and other drilling bits and tools known in the art.

As used herein, the term "superabrasive material" means and includes any material having a Knoop hardness value of about 3,000 $Kg_f/mm^2$ (29,420 MPa) or more. Superabrasive materials include, for example, diamond and cubic boron nitride. Superabrasive materials may also be characterized as "superhard" materials.

As used herein, the term "polycrystalline material" means and includes any structure comprising a plurality of grains (i.e., crystals) of material that are bonded directly together by inter-granular bonds. The crystal structures of the individual grains of the material may be randomly oriented in space within the polycrystalline material.

As used herein, the terms "inter-granular bond" and "inter-bonded" mean and include any direct atomic bond (e.g., covalent, metallic, etc.) between atoms in adjacent grains of superabrasive material.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

As used in this disclosure, any relational term, such as "first," "second," "over," "top," "bottom," "side," etc., is used for clarity and convenience in understanding the disclosure and accompanying drawings and does not connote or depend on any specific preference, orientation, or order, except where the context clearly indicates otherwise.

This disclosure relates generally to rotatable cutting elements for earth-boring tools which may reduce an axial length of the rotatable cutting elements. More specifically, embodiments disclosed herein relate generally to rotatable cutting elements for earth-boring tools which may include an axial thrust-bearing surface located within a recess extending into a substrate of the rotatable cutting element toward a cutting face thereof.

The rotatable cutter assemblies described in this specification may include a rotatable cutting element at least partially disposable within a corresponding sleeve. The rotatable cutting element is able to rotate within the sleeve as the earth-boring tool contacts a formation. Rotation of the rotatable cutting element enables its cutting face to engage the formation using an entire circumferential outer edge of the cutting face, rather than one section or segment of the outer edge. As a result, the cutting surface may wear more uniformly around the outer edge and the rotatable cutting element may not wear as quickly as non-rotatable cutting elements.

Referring to FIG. 1, illustrated is an example earth-boring tool 100 that may employ the principles of this disclosure.

The earth-boring tool 100 shown in FIG. 1 may be configured as a fixed-cutter earth-boring tool, but rotatable cutting elements in accordance with this disclosure may be used with other earth-boring tools, as discussed previously. The earth-boring tool 100 has a body 102 that may include one or more radially and longitudinally extending blades 104. The body 102 may include hard materials suitable for downhole use (e.g., metal- or metal-alloy-cemented particles of tungsten carbide).

The body 102 further includes a plurality of cutting elements 108 at least partially disposed within a corresponding plurality of pockets 106 sized and shaped to receive the plurality of cutting elements 108. The plurality of cutting elements 108 is secured in the blades 104 and pockets 106 at predetermined angular orientations and radial locations to present the plurality of cutting elements 108 with a desired orientation (e.g., backrake and siderake angle) against the formation being penetrated. As a drill string to which the earth-boring tool 100 is connected is rotated, the plurality of cutting elements 108 is driven into and removes the formation by the combined forces of the weight-on-bit and the torque experienced at the earth-boring tool 100.

According to an embodiment of the disclosure, the cutting elements 108 of the earth-boring tool 100 of FIG. 1 may be rotatable. As the rotatable cutting element contacts the formation, contact with the formation by the cutting edge and the adjacent portion of the cutting face may urge the cutting element to rotate about its central axis. A side rake of the cutting element, in addition to the normal back rake employed with PDC cutting elements may facilitate rotation of the cutting element in response to contact with the formation being drilled. Rotation of the cutting element may allow the table to engage the formation using the entire circumference of the cutting edge, rather than the same section or segment of the cutting edge. This may generate more uniform edge wear on the cutting element, reducing the potential for formation of a localized, flat area on the cutting edge of the table and a wear flat on the substrate to the rear of the table. As a result, the rotatable cutting element may not wear as quickly in one region and thereby exhibit longer downhole life and increased efficiency.

Figure 2:
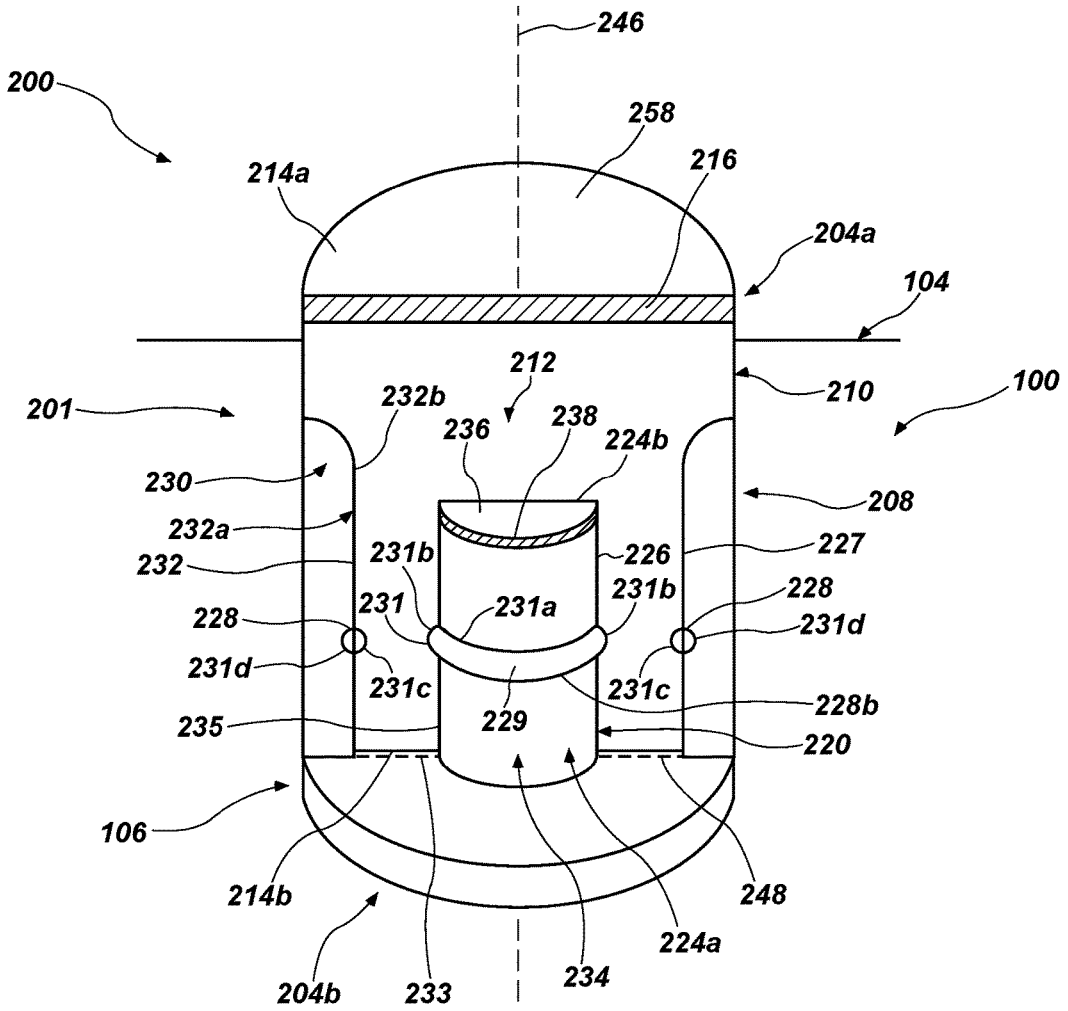
FIG. 2 is a partial cutaway perspective view of an embodiment of a rotatable cutter assembly according to this disclosure.

FIG. 2 is a partial cutaway perspective view of an embodiment of a rotatable cutter assembly 200, which may be used as of one or more of the cutting elements 108 of FIG. 1. As illustrated, the assembly 200 may be coupled to and otherwise associated with a blade 104 of the earth-boring tool 100. In other embodiments, however, the assembly 200 may be coupled to any other static component of an earth-boring tool 100, without departing from the scope of the disclosure. For instance, in at least one embodiment, the assembly 200, may be coupled to a rotationally leading face 105 of the blade 104 of the earth-boring tool 100, in a backup cutter row, or in a gage region. The leading face 105 of the blade 104 faces in the general direction of rotation for the blade 104. A pocket 106 may be formed in the blade 104 at the leading face 105 of the blade 104. The pocket 106 may include or otherwise provide a receiving end 204*a*, a bottom end 204*b*, and a sidewall 208 that extends between the receiving and bottom ends 204*a* and 204*b*, respectively.

The assembly 200 may further include a generally cylindrical rotatable cutting element 210 configured to be disposed within the pocket 106. The receiving end 204*a* of the pocket 106 may define a generally cylindrical opening configured to receive a rotatable cutting element 210 at least partially into the pocket 106. The rotatable cutting element 210 may include a substrate 212 having a first end 214*a* and a second end 214*b*. As illustrated, the first end 214*a* may extend out of the pocket 106 a short distance and the second end 214*b* may be configured to be arranged within the pocket 106 at or near the bottom end 204*b*.

The substrate 212 may be formed of a variety of hard materials including, but not limited to, steel, steel alloys, metal or metal-alloy-cemented carbide, and any derivatives and combinations thereof. Suitable cemented carbides may contain varying amounts of tungsten carbide (WC), titanium carbide (TiC), tantalum carbide (TaC), and niobium carbide (NbC). Additionally, various binding metals or metal alloys may be included in the substrate 212, such as cobalt, nickel, iron, metal alloys, or mixtures thereof. In the substrate 212, the metal carbide particles are supported within a metallic binder, such as cobalt. In other cases, the substrate 212 may be formed of a sintered tungsten carbide composite structure.

As illustrated in FIG. 2, the substrate 212 may further include a recess 220 extending from the second end 214*b* of the substrate 212 toward the first end 214*a* of the substrate 212. The recess 220 may be generally cylindrical in shape. The recess 220 may have a receiving end 224*a*, a terminal end 224*b*, and a sidewall 226 extending between the receiving and terminal ends 224*a*, 224*b*. A table 216 may be disposed on the substrate 212 at the first end 214*a*.

As illustrated, the assembly 200 may further include a sleeve 230 configured to receive the rotatable cutting element 210 at least partially therein. The sleeve 230 may include a variety of hard materials, such as, for example, tungsten carbide and/or steel. The sleeve 230 may include at least one radial bearing surface 232*a* positioned for sliding contact with a corresponding radial bearing surface 232*b* of the substrate 212. The radial bearing surface 232*a* of the sleeve 230 may be located, for example, on an inner surface of the sleeve 230 proximate to a periphery of the sleeve 230, and the radial bearing surface 232*b* may be located, for example, on an outer surface of the substrate 212 at a periphery of the substrate 212 within the sleeve 230. The substrate 212 may be generally cylindrical in shape and may be sized and shaped to be positioned at least partially within the sleeve 230. When the substrate 212 is at least partially positioned within the sleeve 230, the radial bearing surface 232*a* of the sleeve 230 may make rotational, sliding contact with the radial bearing surface 232*b* of the substrate 212. The sleeve 230 may also be generally cylindrical in shape and may be sized and shaped to at least partially receive the substrate 212.

The sleeve 230 may also include a backing support 234, which may be sized, shaped, and positioned to extend into the recess 220 of the substrate 212 of the rotatable cutting element 210. The sleeve 230 may also include at least one axial thrust-bearing surface 236 located on the backing support 234 and positioned to make sliding contact with the substrate 212 within the recess 220. In some embodiments, the second end 214*b* of the substrate 212 may contact the bottom end 233 of the sleeve 230, and thus, the bottom end 233 of the sleeve 230 may be a thrust-bearing surface. In other embodiments, the second end 214*b* of the substrate 212 may not contact the bottom end 233 of the sleeve 230, and thus, the bottom end 233 of the sleeve 230 may not be a thrust-bearing surface. In at least one embodiment, there may be an axial space 248 between the sleeve 230 and the second end 214*b* of the substrate. The axial space 248 may be located longitudinally between the substrate 212 and the sleeve 230, and may extend radially from the backing support 234 to the radial bearing surface 232 at the periphery of the recess 220 within the sleeve 230 into which the rotatable cutting element 210 is at least partially received proximate the receiving end 224*a* of the recess 220 in the substrate 212. In use, the axial thrust-bearing surface 236 of the backing support 234 may provide a low-friction bearing surface on which the substrate may slidably rotate as the rotatable cutting element 210 rotates about a central axis 246.

As illustrated, in at least one embodiment, there may be another table 238 including a polycrystalline, superhard material disposed on the axial thrust-bearing surface 236 of the backing support 234. In use, the other table 238 may increase wear resistance and reduce a coefficient of friction at the contact surface between the polycrystalline table 238 and the substrate 212 within the recess 220 as the rotatable cutting element 210 rotates about a central axis 246. In some embodiments, there may be a table 238 disposed on the axial thrust-bearing surface 236 of the backing support 234 and a polycrystalline, superhard material located on at least one surface of the substrate 212 defining the recess 220. For example, the polycrystalline, superhard material may be located on a surface defining a terminal end 224*b* of the recess 220 within the substrate 212. In some embodiments, the polycrystalline, superhard material may be disposed on at least one of the radial thrust-bearing surfaces 232*a*, 235 of the sleeve 230 and/or the radial thrust-bearing surfaces 232*b*, 226 of the substrate 212. Thus, in use the low-friction, high-wear-resistance contact surface between the polycrystalline table 238 and the substrate 212 within the recess 220 as the rotatable cutting element 210 rotates about a central axis 246 may reduce friction and increase wear resistance when the axial thrust-bearing surface includes at least one polycrystalline, superhard material at the contacting interface, and optionally two polycrystalline, superhard materials in sliding contact with one another. The at least one axial thrust-bearing surface 236 located on the backing support 234 and a portion of the backing support 234 underlying the at least one axial thrust-bearing surface 236 and located at least partially within the recess 220 of the substrate 212 may reduce the overall length requirement of the rolling cutter assembly 200 while maintaining axial 236 and radial 232 bearing surfaces. For example, the direct, sliding contact between the substrate 212 and the axial thrust bearing surface 236 of the backing support 234 of the sleeve 230 may reduce or eliminate the need for length-increasing rolling elements located longitudinally between the rotatable cutting element 210 and the sleeve 230 to bear axial loads.

As illustrated, the assembly 200 may further include a retention mechanism 228 configured to secure the rotatable cutting element 210 within the sleeve 230. The retention mechanism 228 may be any device or mechanism configured to enable the rotatable cutting element 210 to rotate about its central axis 246 within the sleeve 230 while simultaneously inhibiting longitudinal removal of the rotatable cutting element 210 from the sleeve 230. In some embodiments, as illustrated, the retention mechanism 228 may be a snap ring 229 disposed within a space 231 located within a first groove 231*a* located in a surface of a sidewall 235 of the backing support 234 and a second groove 231*b* located in a surface of a sidewall 226 of the recess 220 of the rotatable cutting element 210. The first groove 231*a* may be at least substantially aligned with, and may exhibit at least substantially the same size and shape as, the second groove 231*b* so that when the rotatable cutting element 210 is positioned at least partially within the sleeve 230 the first groove 231*a* and the second groove 231*b* may create a space 231 for the placement of the snap ring 229. While described herein as a snap ring, those skilled in the art will readily appreciate that the retention mechanism 228 may alternatively comprise any other device or mechanism that enables the rotatable cutting element 210 to rotate while simultaneously inhibiting its removal from the sleeve 230. In other embodiments, the rotatable cutting element 210 may be retained in the sleeve 230 by a variety of mechanisms, including such as, for example, an O-ring, a wave or Belleville spring, ball bearings, pins, or mechanical interlocking that rotatably secures the rotatable cutting element 210 within the sleeve 230. Moreover, it will further be appreciated that multiple retention mechanisms 228 may also be used, without departing from the scope of the disclosure.

Figure 4:
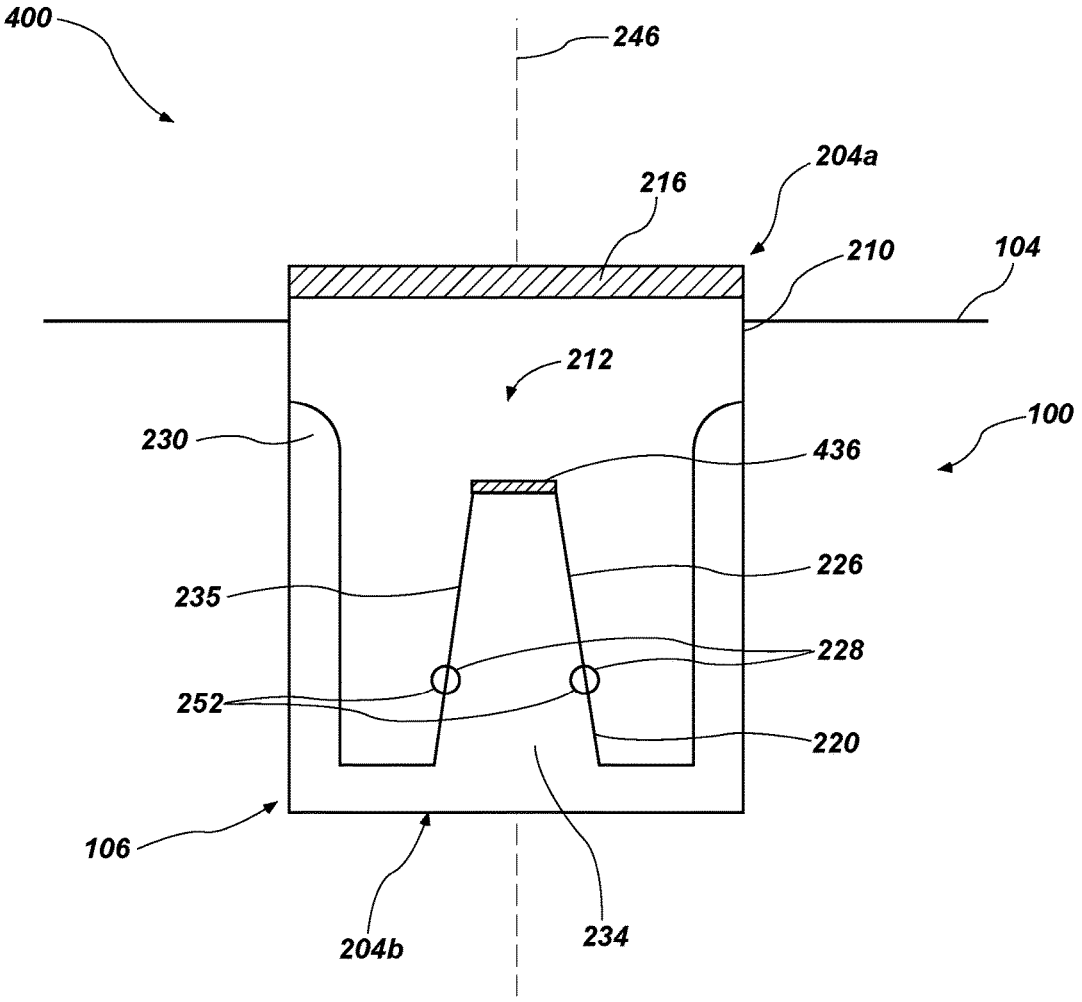
FIG. 4 is a cross-sectional side view of yet another embodiment of a rotatable cutter assembly according to this disclosure.

Additionally, the retention mechanism or mechanisms 228 may be located in one or more locations. For example, the retention mechanism 228 may be located at a first location 251 between the radial periphery of the substrate 212 and the radial bearing surface 232 located on a sidewall 227 of the sleeve 230 within the recess 220 as shown in FIG. 2. In another embodiment, the retention mechanism 228 may be located at a second location 252 between the inner sidewall surface 226 of the substrate 212 within the recess 220 extending into the substrate 212 and a radial periphery of the backing support 234 of the sleeve 230 as shown in FIG. 4. In another embodiment at least one retention mechanism 228 may be located at the first location 251 and at least a second retention mechanism 228*b* may be located at the second location 252, as shown in FIG. 2.

The embodiments described above and below are not to be considered as separate, distinct embodiments, but are illustrative of features that may be selectively combined with one another to produce rotatable cutting elements of various types.

Figure 3:
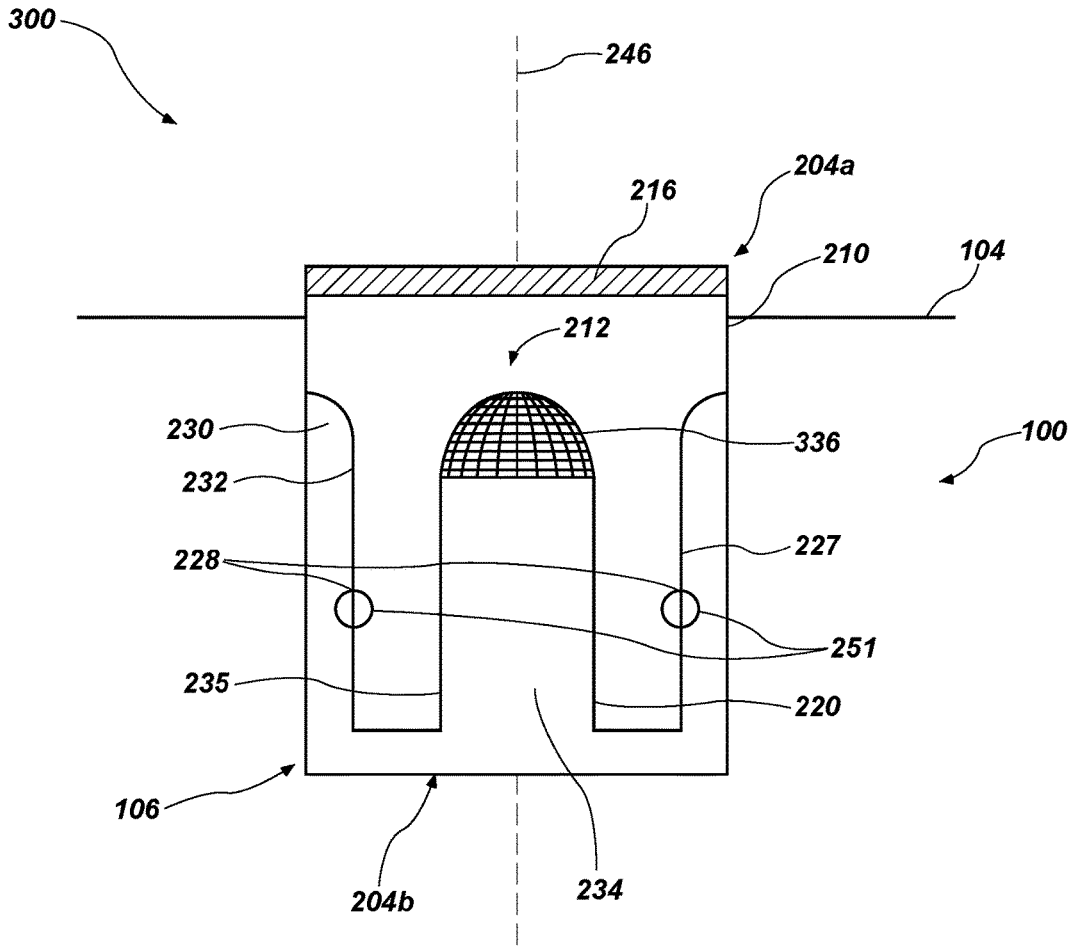
FIG. 3 is a cross-sectional side view of another embodiment of a rotatable cutter assembly according to this disclosure.

FIGS. 3 and 4 are cross-sectional side views of two different embodiments of rotating cutter assemblies 300 and 400 which may be used in lieu of one or more of the cutting elements 108 of FIG. 1. As illustrated, either of the assemblies 300 and 400 may be configured to be coupled to and otherwise associated with the pocket 106 defined within a blade 104 of the earth-boring tool 100. Moreover, either of the assemblies 300 and 400 may further include the rotatable cutting element 210 configured to be rotatably disposed within the pocket 106 and, more particularly, received within the receiving end 204*a* of the pocket 106 and positioned therein such that the second end 214*b* of the rotatable cutting element 210 is arranged at or near the bottom end 204*b*. Either of the assemblies 300 and 400 may also include a sleeve 230 arranged within the pocket 106 at the bottom end 204*b*. As with the assembly 200, the sleeve 230 may be brazed into the bottom end 204*b* of the pocket 106 may be cast directly into the bottom end 204*b* of the pocket 106 during fabrication of the earth-boring tool 100, or may be machined from the material of the blade 104 within the pocket 106, as described below. Accordingly, in at least one embodiment, the sleeve 230 in either of the assemblies 300 and 400 may be separately formed from and subsequently attached to, or integrally formed with and otherwise disposed within, the pocket 106.

Unlike the assembly 200 shown in FIG. 2, however, the assembly 300 may further comprise a hemispherical axial thrust-bearing surface 336, as illustrated in FIG. 3. In some embodiments the surface 224*b* of the backing support 234 configured to bear axial loads applied to the rotatable cutting element 210 may be hemispherical in shape. In these embodiments the backing support 234 may be positioned to make sliding contact with the substrate 212 within the recess 220. In these embodiments there may or may not be a generally cylindrical backing support sidewall 235. Also in these embodiments the axial and radial thrust-bearing surface may include the surface area of the hemispherical-shaped backing support 234 which is in sliding contact with the substrate 212.

Unlike the assemblies 200 and 300 shown in FIGS. 2 and 3, the assembly 400 depicted in FIG. 4 may include a frustoconical axial thrust-bearing surface 436. In such an embodiment the backing support 234 and the recess 220 may be generally frustoconical in shape. In these embodiments the circular, planar frustum forming the axial thrust-bearing surface 236 may be positioned to make sliding contact with the substrate 212 within the recess 220. In these embodiments there may or may not be a generally cylindrical backing support sidewall 235. Also in these embodiments, the backing support sidewall 235 may be both a radial and axial thrust-bearing surface.

Still in other embodiments the backing support 234 and the recess 220 may be generally conical in shape. In these embodiments the backing support 234 may be positioned to make sliding contact with the substrate 212 within the recess 220. In these embodiments there may or may not be a generally cylindrical backing support sidewall 235. Also in these embodiments the radial and axial thrust-bearing surface may be the surface area of the cone-shaped backing support 234 in sliding contact with the substrate 212.

Figure 5:
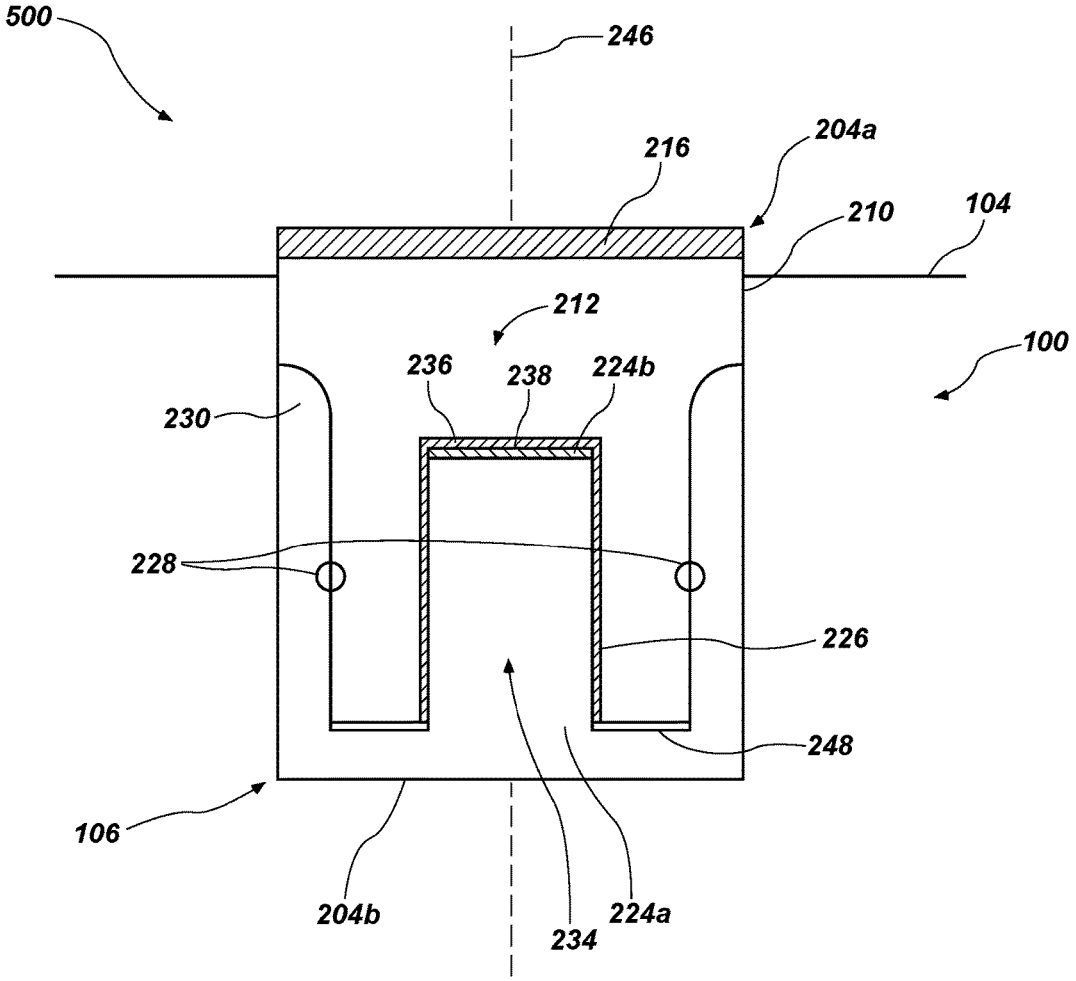
FIG. 5 is a cross-sectional side view of still another embodiment of a rotatable cutter assembly according to this disclosure.

FIG. 5 is a cross-sectional side view of another example rotating cutter assembly 500 which may be used as one or more of the cutting elements 108 of FIG. 1. As illustrated, the assembly 500 may be configured to be coupled to and otherwise associated with the pocket 106 defined within a blade 104 of the earth-boring tool 100. Moreover, the assembly 500 may further include the rotatable cutting element 210 configured to be rotatably disposed within the pocket 106 and, more particularly, received within the receiving end 204*a* of the pocket 106 and extended therein such that the second end 214*b* of the rotatable cutting element 210 is arranged at or near the bottom end 204*b*. The assembly 500 may also include a sleeve 230 arranged within the pocket 106 at the bottom end 204*b*. As with the assembly 200, the sleeve 230 may be brazed into the bottom end 204*b* of the pocket 106 or may alternatively be cast or machined directly into the bottom end 204*b* of the pocket 106 during fabrication of the earth-boring tool 100, as described above. Accordingly, in at least one embodiment, the sleeve 230 in the assembly 500 may be integrally formed with and otherwise within the pocket 106.

Unlike the assembly 200 shown in FIG. 2, however, the assembly 500 of FIG. 5 may further include a polycrystalline, superhard material disposed on at least one surface 224*b*, 226 of the substrate 212 defining the recess 220. The polycrystalline, superhard material may be disposed on the terminal end 224*b* of the recess 220, on the sidewall 226 of the recess 220, or both. The recess 220 may be generally cylindrical, hemispherical, conical, or frustoconical in shape. In use, the low-friction contact surface between the polycrystalline table 238 and the substrate 212 within the recess 220 as the rotatable cutting element 210 rotates about a central axis 246 may be improved further with a diamond-on-diamond axial thrust-bearing surface. The at least one axial thrust-bearing surface 236 located on the backing support 234 and the backing support 234 extended into the substrate 212 may reduce the overall length requirement of the rolling cutter assembly 200 while still maintaining axial 236 and radial 232 bearing surfaces.

Referring collectively to FIGS. 1 through 5, the earth-boring tool 100 may be fabricated through a casting process that uses a mold that includes and otherwise contains all the necessary materials and component parts required to produce the earth-boring tool 100 including, but not limited to, reinforcement materials, a binder material, displacement materials, a bit blank, etc. The blade 104 and the pockets 106 may be defined or otherwise formed using the mold and various sand displacements. The earth-boring tool 100 may also be machined from a steel blank. In some embodiments the sleeve 230 may be integrally formed with the earth-boring tool 100 during fabrication of the earth-boring tool 100.

At least a portion of the substrate 212 of the rotatable cutting element 210 may be placed within a recess 220 of the sleeve 230, placing the axial thrust-bearing surface 236 of the sleeve 230 with the substrate 212 of the rotatable cutting element 210 by inserting a protrusion of the sleeve 230 comprising the backing support 234 and the axial thrust-bearing surface 236 into a recess 220 extending into the substrate 212 toward a cutting face 258 of the rotatable cutting element 210 and contacting the axial thrust-bearing surface 236 against the substrate 212. In at least one embodiment, contacting the axial thrust-bearing surface 236 may comprise placing a superhard, polycrystalline material of the table 216 of the substrate 212 located within the recess 220 in sliding contact with the axial thrust-bearing surface 236 of the sleeve 230. In another embodiment, contacting the axial thrust-bearing surface 236 may comprise placing a superhard, polycrystalline material of the axial thrust-bearing surface 236 in sliding contact with the substrate 212 within the recess 220.

The rotatable cutting element 210 may then be secured to the sleeve 230 utilizing at least one retention mechanism 228, the retention mechanism 228 permitting the rotatable cutting element 210 to rotate relative to the sleeve 230.

In at least one embodiment, the rotatable cutting element 210 may be secured to the sleeve 230 by installing a snap ring within a space located within a first groove in a surface of the sleeve 230 and a second groove in a surface of the sidewall 226 of the recess 220 extending into the substrate 212 of the rotatable cutting element 210, the second groove substantially matching the first groove, as described above.

In at least one embodiment, an axial space 248 between the substrate 212 and the sleeve 230 may be left between the substrate 212 and the sleeve 230, the axial space 248 radially surrounding the protrusion of the sleeve 230 within the recess 220 of the substrate 212. The axial space 248 may be generally annular in shape and having also an at least substantially rectangular cross-sectional shape. The axial space 248 may extend out radially from the backing support 234 to the radial bearing surface of the sleeve 232*a*. Also, the axial space 248 may extend up from the bottom end 233 of the sleeve 230 to the second end 214*b* of the substrate 212.

Additional non-limiting example embodiments of the disclosure are set forth below.

Embodiment 1

A cutter assembly, comprising: a rotatable cutting element comprising: a substrate; a table comprising a superhard polycrystalline material disposed on a first end of the substrate; and a recess extending into a second opposite end of the substrate; a sleeve receiving the rotatable cutting element at least partially therein, the sleeve comprising: at least one radial bearing surface; a backing support extending into the recess of the rotatable cutting element; and at least one axial thrust-bearing surface located on the backing support in contact with the substrate within the recess; and at least one retention mechanism configured to secure the rotatable cutting element within the sleeve.

Embodiment 2

The cutter assembly of Embodiment 1, wherein the at least one axial thrust-bearing surface further comprises a superhard, polycrystalline material disposed thereon.

Embodiment 3

The cutter assembly of Embodiment 1, wherein the at least one axial thrust-bearing surface is planar, hemispherical, conical, or frustoconical.

Embodiment 4

The cutter assembly of Embodiment 1, wherein the sleeve comprises a tungsten carbide or steel material.

Embodiment 5

The cutter assembly of Embodiment 1, wherein the sleeve further comprises a first annular groove in a surface of the backing support, wherein the rotatable cutting element further comprises a second annular groove in a surface of a sidewall of the recess of the rotatable cutting element, aligned with the first annular groove, and wherein the retention mechanism comprises a snap ring disposed within the first annular groove and extending radially outward into the second annular groove.

Embodiment 6

The cutter assembly of Embodiment 1, wherein a surface of the substrate defining a terminal end of the recess comprises a superhard, polycrystalline material disposed thereon.

Embodiment 7

An earth-boring tool, comprising: a bit body; at least one blade extending from the bit body; at least one pocket defined in the at least one blade; at least one sleeve secured within the at least one pocket; at least one rotatable cutting element disposed within the at least one sleeve, the at least one rotatable cutting element comprising: a substrate; a table comprising a superhard, polycrystalline material disposed on a first end of the substrate; a recess extending into a second, opposite end of the substrate; and at least one radial bearing surface; and at least one retention mechanism securing the rotatable cutting element within the sleeve; wherein the sleeve comprises: at least one internal radial bearing surface in sliding contact with radial bearing surface of the at least one rotatable cutting element; a backing support extending into the recess of the rotatable cutting element; and at least one axial thrust-bearing surface located on the backing support and in contact with the substrate within the recess.

Embodiment 8

The earth-boring tool of Embodiment 7, wherein the at least one axial thrust-bearing surface comprises a superhard polycrystalline material disposed thereon.

Embodiment 9

The earth-boring tool of Embodiment 7, wherein the at least one axial thrust-bearing surface is planar, hemispherical, conical, or frustoconical.

Embodiment 10

The earth-boring tool of Embodiment 7, wherein the at least one sleeve is furnaced into the blade during formation of the earth-boring tool.

Embodiment 11

The earth-boring tool of Embodiment 7, wherein a surface defining a terminal end of the recess within the substrate comprises a superhard, polycrystalline material disposed thereon.

Embodiment 12

The earth-boring tool of Embodiment 7, wherein the sleeve further comprises a first annular groove in a surface of the backing support, wherein the rotatable cutting element further comprises a second annular groove in a surface of a sidewall of the recess of the rotatable cutting element, aligned with the first annular groove, and wherein the retention mechanism comprises a snap ring disposed within the first annular groove and extending radially outward into the second annular groove.

Embodiment 13

The earth-boring tool of Embodiment 7, wherein the sleeve comprises a tungsten carbide or steel material.

Embodiment 14

A method of fabricating an earth-boring tool, comprising: securing a sleeve to a bit body at least partially within a pocket extending into a blade extending outward from the bit body; placing at least a portion of a substrate of a rotatable cutting element within a recess of the sleeve, comprising placing an axial thrust-bearing surface of the sleeve in contact with the substrate of the rotatable cutting element by inserting a protrusion of the sleeve comprising the axial thrust-bearing surface into a recess extending into the substrate toward a cutting face of the rotatable cutting element; and securing the rotatable cutting element to the sleeve utilizing at least one retention mechanism, the retention mechanism permitting the rotatable cutting element to rotate relative to the sleeve.

Embodiment 15

The method of Embodiment 14, wherein securing the sleeve to the bit body comprises casting the sleeve at least partially within the pocket when forming the bit body.

Embodiment 16

The method of Embodiment 14, wherein securing the sleeve to the bit body comprises brazing the sleeve to the bit body at least partially within the pocket.

Embodiment 17

The method of Embodiment 14, wherein securing the rotatable cutting element to the sleeve comprises installing a snap ring within a first annular groove in a surface of the sleeve and extending radially outward into a second annular groove in a surface of a sidewall of the rotatable cutting element, and wherein the first annular groove is aligned with the second annular groove.

Embodiment 18

The method of Embodiment 14, wherein contacting the axial thrust-bearing surface against the substrate comprises placing a superhard, polycrystalline material of the substrate located within the recess in sliding contact with the axial thrust-bearing surface of the sleeve.

Embodiment 19

The method of Embodiment 14, wherein contacting the axial thrust-bearing surface against the substrate comprises placing a superhard, polycrystalline material of the axial thrust-bearing surface in sliding contact with the substrate within the recess.

Embodiment 20

The method of Embodiment 14, further comprising leaving an axial space between the substrate and the sleeve, the axial space radially surrounding the protrusion of the sleeve within the recess.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A cutter assembly, comprising:

a rotatable cutting element comprising:

a substrate;

a table comprising a superhard, polycrystalline material disposed on a first end of the substrate; and a recess extending into a second, opposite end of the substrate;

a sleeve receiving the rotatable cutting element at least partially therein, the sleeve comprising:

at least one radial bearing surface;

a backing support extending into the recess of the rotatable cutting element; and at least one axial thrust-bearing surface located on the backing support and in contact with the substrate within the recess, the at least one axial thrust-bearing surface comprising a superhard, polycrystalline material disposed thereon and in contact with the substrate within the recess; and at least one retention mechanism configured to secure the rotatable cutting element within the sleeve.

2. The cutter assembly of claim 1, wherein the at least one axial thrust-bearing surface is planar, hemispherical, conical, or frustoconical.

3. The cutter assembly of claim 1, wherein the sleeve comprises a tungsten carbide or a steel material.

4. The cutter assembly of claim 1, wherein the sleeve further comprises a first annular groove in a surface of the backing support, wherein the rotatable cutting element further comprises a second annular groove in a surface of a sidewall of the recess of the rotatable cutting element aligned with the first annular groove, and wherein the retention mechanism comprises a snap ring disposed within the first annular groove and extending radially outward into the second annular groove.

5. The cutter assembly of claim 1, wherein a surface of the substrate defining a terminal end of the recess comprises a superhard, polycrystalline material disposed thereon.

6. An earth-boring tool, comprising:

a bit body;

at least one blade extending from the bit body;

at least one pocket defined in the at least one blade;

at least one sleeve secured within the at least one pocket;

at least one rotatable cutting element disposed within the at least one sleeve, the at least one rotatable cutting element comprising:

a substrate;

a table comprising a superhard, polycrystalline material disposed on a first end of the substrate;

a recess extending into a second, opposite end of the substrate; and at least one radial bearing surface; and at least one retention mechanism securing the rotatable cutting element within the sleeve;

wherein the sleeve comprises:

at least one internal radial bearing surface in sliding contact with radial bearing surface of the at least one rotatable cutting element;

a backing support extending into the recess of the rotatable cutting element; and at least one axial thrust-bearing surface located on the backing support and in contact with the substrate within the recess, the at least one axial thrust-bearing surface comprising a superhard, polycrystalline material disposed thereon and in contact with the substrate within the recess.

7. The earth-boring tool of claim 6, wherein the at least one axial thrust-bearing surface is planar, hemispherical, conical, or frustoconical.

8. The earth-boring tool of claim 6, wherein the at least one sleeve is integrally formed into the blade during formation of the earth-boring tool.

9. The earth-boring tool of claim 6, wherein a surface defining a terminal end of the recess within the substrate comprises a superhard, polycrystalline material disposed thereon.

10. The earth-boring tool of claim 6, wherein the sleeve further comprises a first annular groove in a surface of the backing support, wherein the rotatable cutting element further comprises a second annular groove in a surface of a sidewall of the recess of the rotatable cutting element, aligned with the first annular groove, and wherein the retention mechanism comprises a snap ring disposed within the first annular groove and extending radially outward into the second annular groove.

11. The earth-boring tool of claim 6, wherein the sleeve comprises a tungsten carbide or steel material.

* * * * *